US011918033B2

(12) United States Patent
Ashton

(10) Patent No.: US 11,918,033 B2
(45) Date of Patent: Mar. 5, 2024

(54) ROLLING PAPERS WITH DISCRETE ADHESIVE AREAS

(71) Applicant: Jason Ashton, Watsonville, CA (US)

(72) Inventor: Jason Ashton, Watsonville, CA (US)

( * ) Notice: Subject to any disclaimer, the term of this patent is extended or adjusted under 35 U.S.C. 154(b) by 0 days.

(21) Appl. No.: 17/735,760

(22) Filed: May 3, 2022

(65) Prior Publication Data

US 2023/0337722 A1 Oct. 26, 2023

Related U.S. Application Data

(60) Provisional application No. 63/333,086, filed on Apr. 20, 2022.

(51) Int. Cl.
*A24D 1/02* (2006.01)

(52) U.S. Cl.
CPC ..... *A24D 1/022* (2013.01)

(58) Field of Classification Search
CPC ..... A24D 1/02; A24D 1/022; A24D 1/025; A24C 5/46; A24C 5/465; A24C 5/47; A24C 5/54; D21H 5/16
USPC ..... 131/365; 162/139
See application file for complete search history.

(56) References Cited

U.S. PATENT DOCUMENTS

| | | | | |
|---|---|---|---|---|
| 10,485,264 | B2 * | 11/2019 | Slama et al. | D21H 5/16 |
| 2012/0097179 | A1 * | 4/2012 | Kesselman | A24D 1/02 131/365 |
| 2015/0034100 | A1 * | 2/2015 | Park et al. | A24C 5/007 131/365 |
| 2016/0050971 | A1 * | 2/2016 | Harrison | B32B 7/06 131/365 |
| 2018/0077964 | A1 * | 3/2018 | Farmer | A24D 1/022 |
| 2019/0320711 | A1 * | 10/2019 | Wander | A24D 3/043 |
| 2021/0352958 | A1 * | 11/2021 | Pandolfino | A24D 1/02 |
| 2022/0022525 | A1 * | 1/2022 | Bosh-Sanchez | A24C 5/44 |
| 2023/0023799 | A1 * | 1/2023 | Ashton | A24D 3/0266 |

FOREIGN PATENT DOCUMENTS

| | | | | |
|---|---|---|---|---|
| GB | 2318992 | * | 5/1998 | A24D 1/02 |
| WO | WO 2020/200332 | * | 10/2020 | A24D 1/022 |

* cited by examiner

*Primary Examiner* — Dionne W. Mayes
(74) *Attorney, Agent, or Firm* — Donald R. Boys; Central Coast Patent Agency LLC

(57) ABSTRACT

A rolling paper has a rectangular region being one side surface of the rolling paper, the rectangular region having a first and a second long edge of a first length and a first and a second short edge of second length, a first adhesive strip having a first width less than one-fourth of the second length along the full length of the first long edge, and a second adhesive strip of a third length less than one-half the first length of the first long edge, and a second width less than one-fourth of the second length, the second adhesive strip along the second long edge, one end of the second adhesive strip abutting the first short edge.

4 Claims, 7 Drawing Sheets

ROLLING PAPERS WITH DISCRETE ADHESIVE AREAS

CROSS-REFERENCE TO RELATED DOCUMENTS

The present application claims priority to provisional application 63/333,086 filed Apr. 20, 2022. All disclosure of the parent applications is incorporated herein at least by reference.

BACKGROUND OF THE INVENTION

1. Field of the Invention

The present invention is in the technical field of rolling cigarettes and pertains more particularly to especially implemented adhesive areas on rolling papers.

2. Description of Related Art

Rolling smokable material into a cigarette by loading the material onto a paper and rolling and sealing the paper typically with adhesive gum into a self-contained cylinder is a well-known process in the art. In the process in the conventional art it is common to add a tip or a filter to the rolling paper prior to rolling the elements into a smokable cylinder, cone or cigarette.

The process of incorporating a tip or filter during the rolling process is also well know in the art. Paper material and other suitable materials, such as wood pulp, leaves, hemp, rice and the like are commercially available both for the rolling of cigarettes and for the rolling of tips and filters. Tips and filters are available commercially in both pre-rolled tip filters and packets of suitable paper material for rolling your own tips and filters are available in pads of multiple flat paper material and the like that may be peeled off the pad and rolled to a desired diameter to be used individually. However, conventional rolling papers do not have an adhesive area designated for securing tips or filters to the rolling paper. As a result, it is a challenge to roll smokable material and a tip or filter into a cigarette. The smokable material and/or the tip or filter may easily fall away in the process.

What is clearly needed is a rolling paper with an adhesive applied in one or more discrete areas such that the tip or filter may adhere securely to the paper, providing a secure rolling process.

SUMMARY OF THE INVENTION

In one embodiment of the invention a rolling paper is provided, comprising a rectangular region being one side surface of the rolling paper, the rectangular region having a first and a second long edge of a first length and a first and a second short edge of second length, a first adhesive strip having a first width less than one-fourth of the second length along the full length of the first long edge, and a second adhesive strip of a third length less than one-half the first length of the first long edge, and a second width less than one-fourth of the second length, the second adhesive strip along the second long edge, one end of the second adhesive strip abutting the first short edge.

In one embodiment the adhesive strip is an adhesive requiring moistening to be active.

In another aspect of the invention a rolling paper is provided, comprising a rectangular region being one side surface of the rolling paper, the rectangular region having a first and a second long edge of a first length and a first and a second short edge of second length, a first adhesive strip having a first width less than one-fourth of the second length along the full length of the first long edge, and a second adhesive strip of a third length less than one-half the first length of the first long edge, and a second width less than one-fourth of the second length, the second adhesive strip along the second long edge, one end of the second adhesive strip abutting the second short edge.

In one embodiment the adhesive strip is an adhesive requiring moistening to be active.

In another aspect of the invention a rolling paper is provided, comprising a rectangular region being one side surface of the rolling paper, the rectangular region having a first and a second long edge of a first length and a first and a second short edge of second length, a first adhesive strip having a first width less than one-fourth of the second length, along the full length of the first long edge, and a second adhesive strip having a first width less than one-fourth of the second length, along the full length of the second long edge.

In one embodiment the adhesive strip is an adhesive requiring moistening to be active.

In yet another aspect of the invention a method for rolling a cigarette is provided, comprising supporting a rolling paper having a rectangular region being one side surface of the rolling paper with the rectangular region facing upward, the rectangular region having a first and a second long edge of a first length and a first and a second short edge of a second length, a first adhesive strip having a first width less than one-fourth of the second length along the full length of the first long edge, and a second adhesive strip of a third length less than one-half the first length of the first long edge, and a second width less than one-fourth of the second length, the second adhesive strip along the second long edge, one end of the second adhesive strip abutting either the first short edge or the second shot edge, moistening the first and the second adhesive strips activating adhesion, placing a tip or a filter on the second adhesive strip, an axis of the tip or filter in the direction of the length of the second adhesive strip, and one end of the tip or filter abutting the first or the second short edge, such that the tip or filter adheres to the second adhesive strip, placing a line of smokable material along the second long edge in line with the tip or filter, and rolling the rolling paper from the second long edge around the tip or filter and the line of smokable material until the rolling paper forms a cylinder held in shape by the first adhesive strip.

In one embodiment the tip or filter is placed with a portion of the tip or filter extending beyond the first or the second short edge. Also, in one embodiment the second adhesive strip is the full length of the second long edge.

DETAILED DESCRIPTION OF THE INVENTION

Figure 1A:
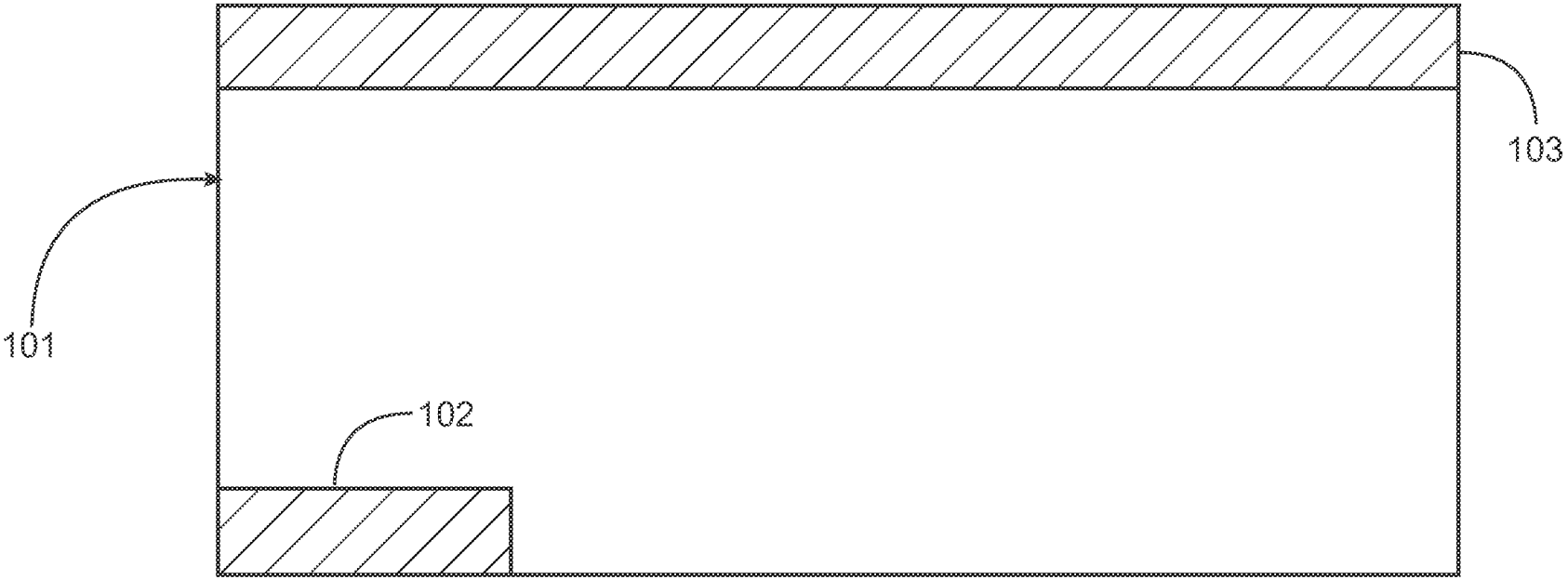
FIG. 1A is a plan view of a rolling paper with specific adhesive areas in one embodiment of the invention.

FIG. 1A is a plan view of a rolling paper 101 in one embodiment of the present invention, the rolling paper being rectangular with two long edges and two short edges. Rolling paper 101 has an adhesive strip area 103 along one long edge, which is common in the art. Rolling paper 101 also has an adhesive area 102 along a relatively small portion of a length of the rolling paper on a long edge opposite adhesive strip area 103, proximate one width edge of the rolling paper. The adhesive in one embodiment may be an adhesive that may be moistened, much like adhesives used on envelope flaps and stamps.

Figure 1B:
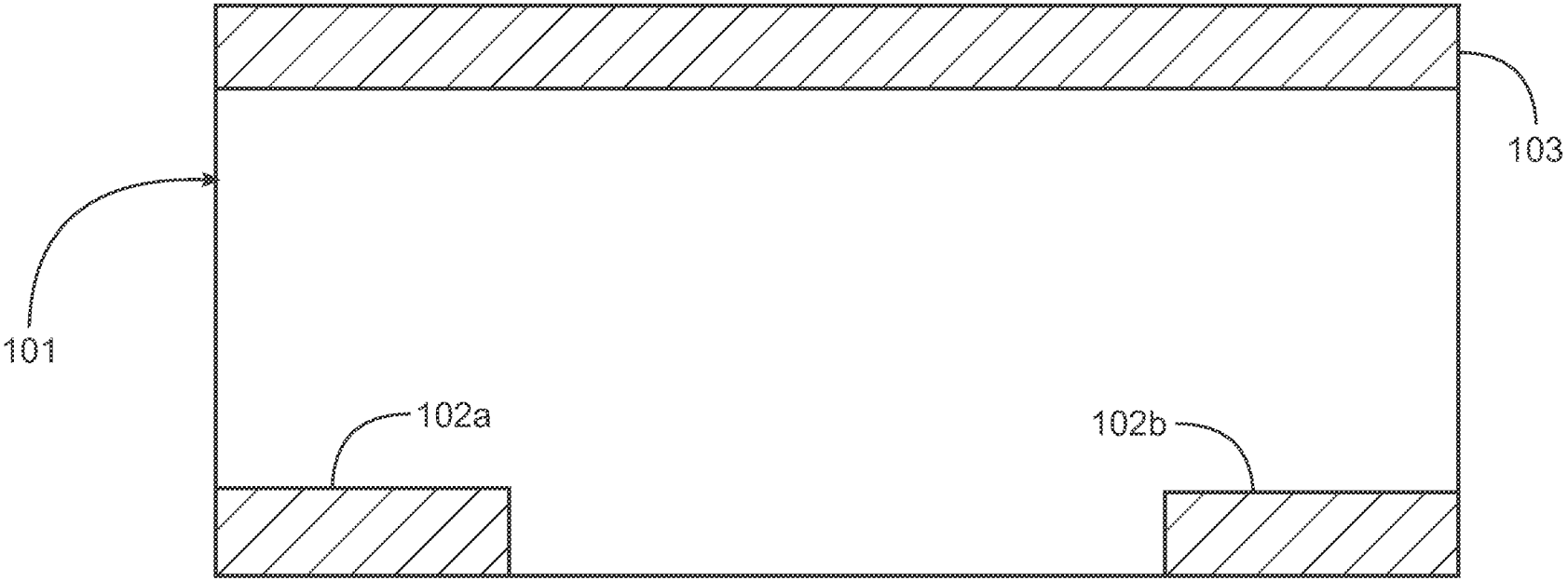
FIG. 1B is a plan view of a rolling paper with specific adhesive areas in an alternative embodiment of the invention.

FIG. 1B is a plan view of a rolling paper of the same dimensions as the rolling paper of FIG. 1A in an embodiment of the invention, with two discrete adhesive areas 102*a* and 102*b* on the long edge opposite adhesive strip 103, one of which is adjacent to one end of the rolling paper and the other adjacent the other end.

Figure 1C:
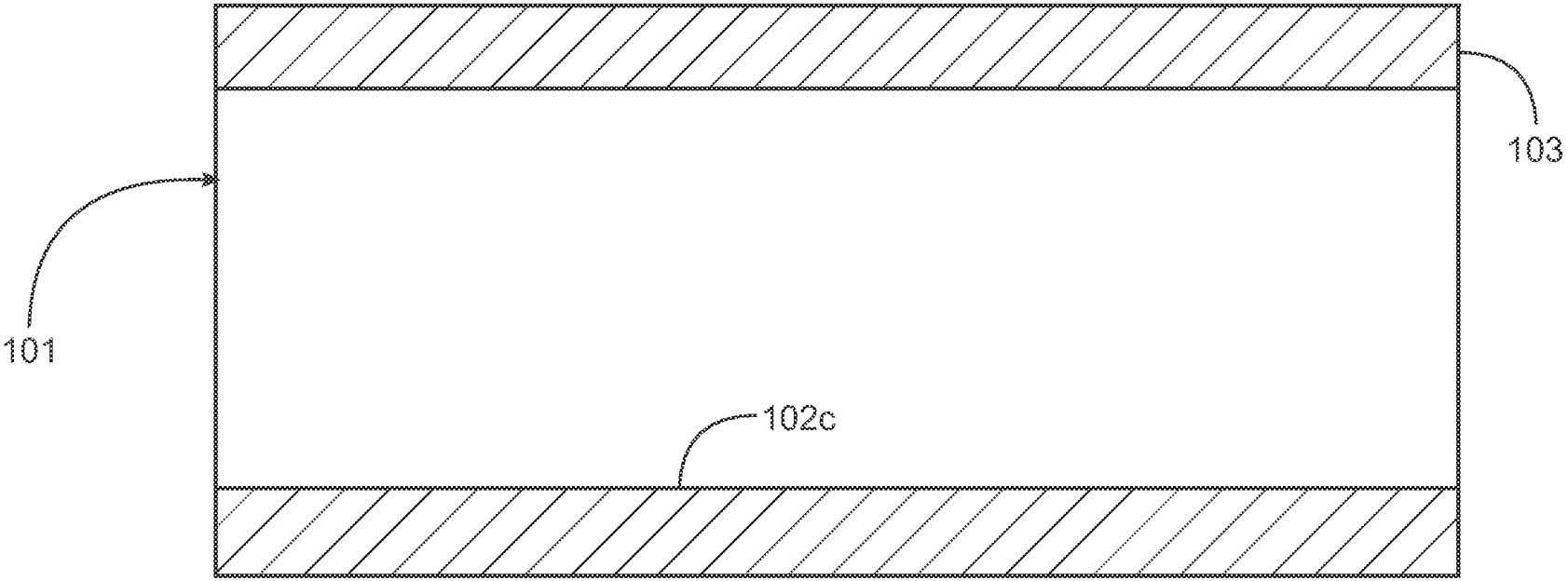
FIG. 1C is a plan view of a rolling paper with specific adhesive areas in another embodiment of the invention.

FIG. 1C is a perspective view of a rolling paper in an embodiment of the invention with discrete adhesive areas covering the entire length of rolling paper on both opposite ling edges.

Figure 2:
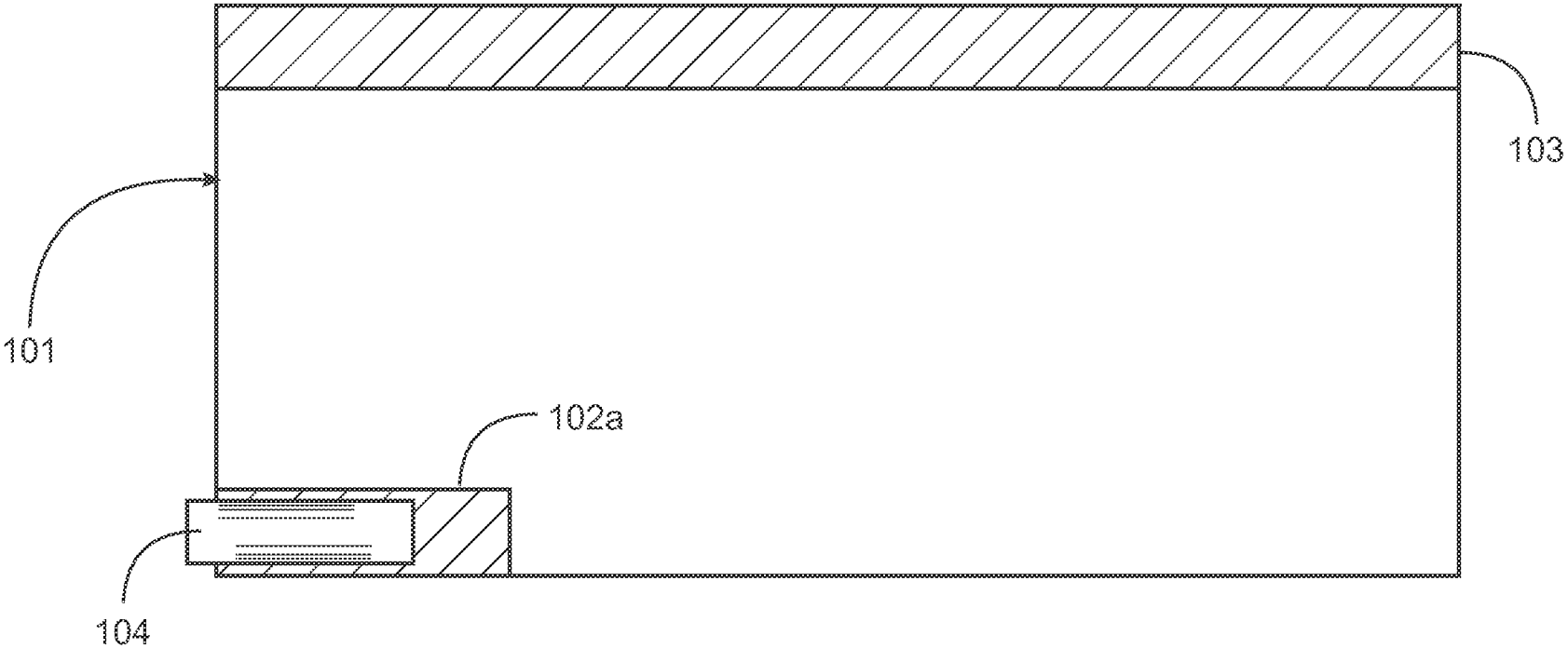
FIG. 2 is a plan view of a rolling paper with specific adhesive areas with a tip or filter secured to the rolling paper by adhesive in an embodiment of the invention.

FIG. 2 is a plan view of the rolling paper of FIG. 1A with a cylindrical tip filter 104 placed on adhesive area 102*a* after activating the adhesive by moistening. Note that in this view the tip filter extends over the left edge of the rolling paper. This not a limitation, as the tip filter might be placed to extend out even further, or less, or may be completely within the dimensions of the rolling paper. The adhesive holds the tip filter 104 on the rolling paper during subsequent operations in rolling a cigarette, as described below.

Figure 3:
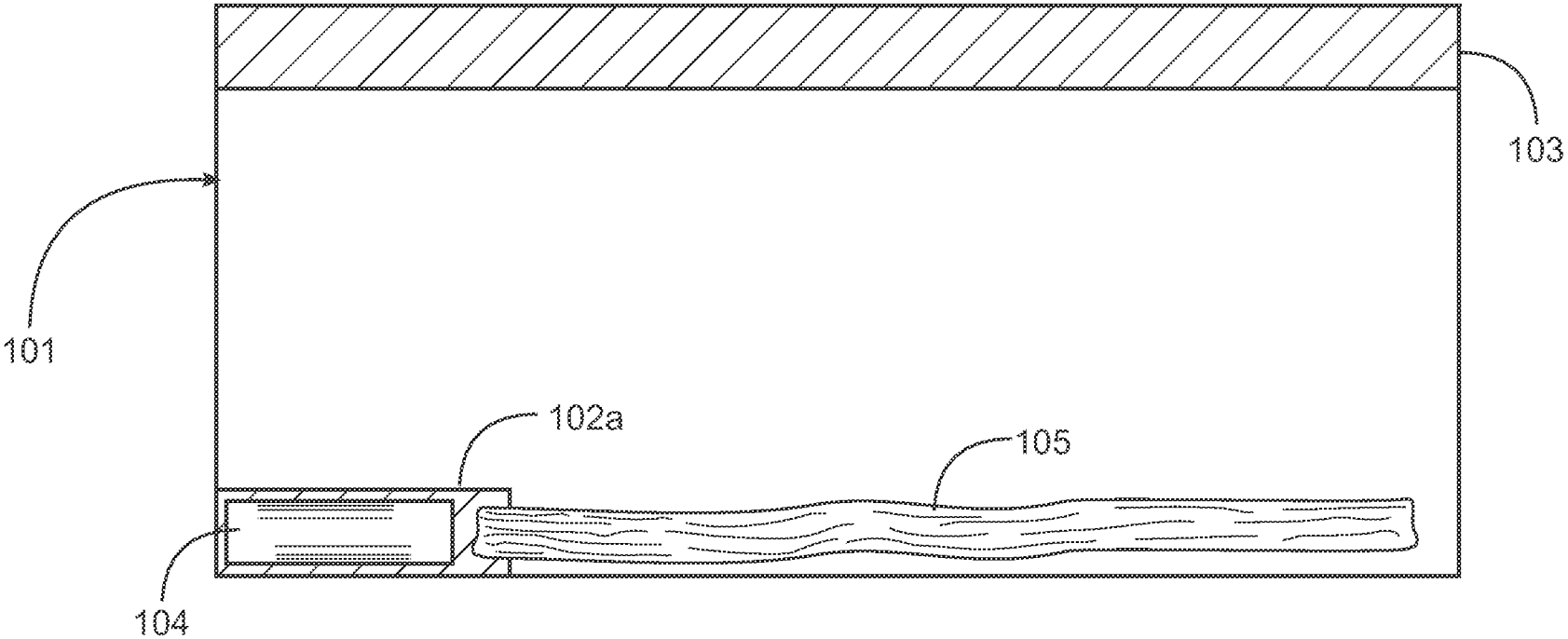
FIG. 3 is the plan view of FIG. 2 with smokable material added to the rolling paper.

FIG. 3 illustrates the rolling paper of FIG. 2 with smokable material 105 added along the lower long edge of the rolling paper, from tip filter 104 to the opposite end of the length of the rolling paper. The rolling paper with the tip filter in place and the smokable material added is now ready to be rolled into a cigarette.

From the circumstance of FIG. 3 a user moistens strip 103 and proceeds to roll the rolling paper into a cigarette from the lower long edge, until the outside of the rolled cylinder meets the adhesive strip 103. This completes the roll and the adhesive strip 103 holds the cigarette together in a cylinder shape.

Figure 4:
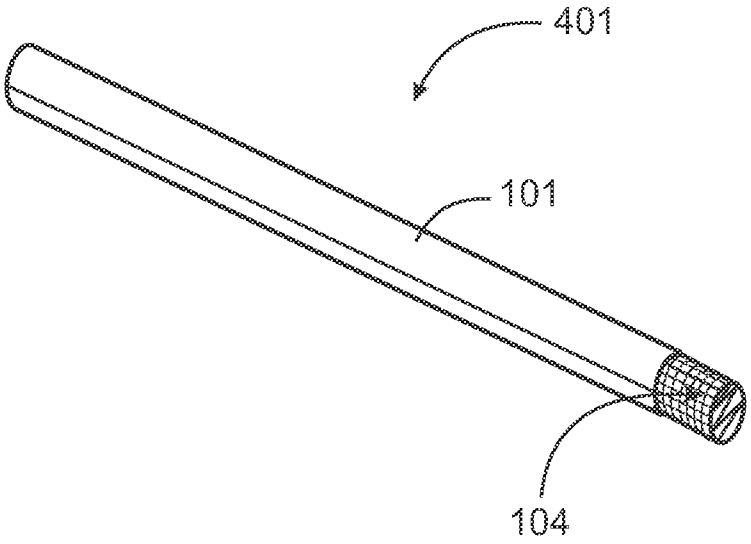
FIG. 4 is a perspective view of a rolled cigarette with a tip or filter extending a short distance from one end in an embodiment of the invention.

FIG. 4 illustrates rolling paper 101 rolled up with tip filter 104 extending out one end of the rolled cylinder, which also now encloses the smokable material, forming a rolled cigarette 401.

Figure 5:
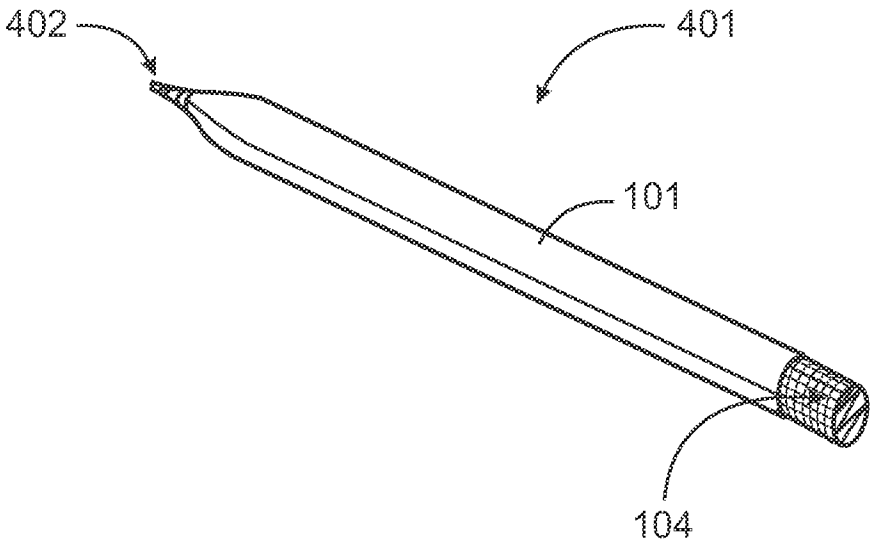
FIG. 5 is the perspective view of FIG. 4 with an end opposite the tip or filter twisted closed.

FIG. 5 illustrates the rolled cigarette of FIG. 4 with one end of the paper cylinder, opposite the end with the tip filter, twisted as shown at end 402.

The skilled person will understand that the adhesive area 102*a* as seen in FIG. 1 will serve to hold tip filter 104 in place as the cigarette is rolled around the tip filter and the smokable material. In the embodiment shown by FIG. 1B a user has a choice of which end of the rolling paper to use to place the tip filter and hold same in place. This is a choice for a left-handed or a right-handed person. In the embodiment shown by FIG. 1C the user can still choose the end for the tip filter, and adhesive area 102*c* will also act to help hold the smokable material in place while the cigarette is rolled.

A skilled person will understand that the embodiments and procedures described above are entirely exemplary, and that there may be many variations within the scope of the invention. The invention is limited only by the scope of the claims.

The invention claimed is:

1. A method for rolling a cigarette, comprising:

supporting a rolling paper having a rectangular region being one side surface of the rolling paper with the rectangular region facing upward, the rectangular region having a first and a second long edge of a first length and a first and a second short edge of a second length, a first adhesive strip having a first width in the direction of the first short edge less than one-fourth of the second length, the first adhesive strip along the full length of the first long edge, and a second adhesive strip applied on the rectangular region separate from and isolated on the rectangular region from the first adhesive strip, the second adhesive strip of a second width in the direction of the first short edge less than one-fourth of the second length, the second adhesive strip along the second long edge, one end of the second adhesive strip abutting either the first short edge or the second short edge;

moistening the first and the second adhesive strips activating adhesion;

placing a tip or a filter on the second adhesive strip, an axis of the tip or filter in the direction of the length of the second adhesive strip such that the tip or filter adheres to the second adhesive strip;

placing a line of smokable material along the second long edge in line with the tip or filter; and rolling the rolling paper from the second long edge around the tip or filter and the line of smokable material until the rolling paper forms a cylinder held in shape by the first adhesive strip.

2. The method of claim 1 wherein the tip or filter is placed with a portion of the tip or filter extending beyond the first or the second short edge.

3. The method of claim 1 wherein the second adhesive strip is the fill length of the second long edge.

4. The method of claim 1 wherein the second adhesive strip is a third length less than one-half the first length of the first long edge.

* * * * *